US006237165B1

(12) United States Patent
Chen et al.

(10) Patent No.: US 6,237,165 B1
(45) Date of Patent: May 29, 2001

(54) ELECTROMAGNETIC CONTROL DEVICE FOR FLUSH TANK

(75) Inventors: Kuan Pao Chen; Yi Tsung Tsai, both of Taichung Hsien (TW)

(73) Assignee: E. Flush Tech Co., Ltd., Chang Hua Hsien (TW)

( * ) Notice: Subject to any disclaimer, the term of this patent is extended or adjusted under 35 U.S.C. 154(b) by 0 days.

(21) Appl. No.: 09/551,726

(22) Filed: Apr. 18, 2000

Related U.S. Application Data

(63) Continuation-in-part of application No. 09/274,291, filed on Mar. 22, 1999, now abandoned.

(51) Int. Cl.[7] ..... E03D 5/10
(52) U.S. Cl. ..... 4/406
(58) Field of Search ..... 4/302, 313, 406

(56) References Cited

U.S. PATENT DOCUMENTS 793,063 6/1905 Ghegan .
2,061,310 * 11/1936 Kleiser ..... 4/406
3,462,768 * 8/1969 Lefebvre et al. ..... 4/406
3,559,217 * 2/1971 Johnson ..... 4/406
5,003,643 * 4/1991 Chung ..... 4/406 X

FOREIGN PATENT DOCUMENTS

0197630 * 8/1990 (JP) ..... 4/406

* cited by examiner

*Primary Examiner*—Charles E. Phillips
(74) *Attorney, Agent, or Firm*—Charles E. Baxley

(57) ABSTRACT

An electromagnetic control device for controlling a flush valve of a flush tank includes a housing, a lever pivotally coupled to the housing to actuate the flush valve. A casing is secured in the housing for slidably receiving an armature which is coupled to the lever with a spring member. An electromagnetic device may actuate the armature to operate the lever via the spring member. A number of plates and one or more magnets are disposed in the casing for maintaining the electromagnetic field generated by the electromagnetic device.

8 Claims, 6 Drawing Sheets

ELECTROMAGNETIC CONTROL DEVICE FOR FLUSH TANK

The present invention is a continuation-in-part of U.S. patent application Ser. No. 09/274,291, filed on Mar. 22, 1999, now abandoned.

BACKGROUND OF THE INVENTION

1. Field of the Invention

The present invention relates to a control device for a flush tank, and more particularly to an electromagnetic control device for controlling and actuating the flush tank.

2. Description of the Prior Art

Typical flush tanks comprise a lever coupled to a flush valve by a link. The lever should be actuated by a force that is large enough to overcome the water pressure applied onto the flush valve. U.S. Pat. No. 793,063 to Ghegan and U.S. Pat. No. 3,462,768 to Lefebvre et al. disclose two typical electromagnetic actuating devices for flush tanks and comprise an armature slidably received in a coil and directly coupled to the flush valve with a link, such as a rod or a chain. No cushioning device or biasing device is provided between the armature and the link to the flush valve.

The present invention has arisen to mitigate and/or obviate the afore-described disadvantages of the conventional flush tank control devices.

SUMMARY OF THE INVENTION

The primary objective of the present invention is to provide an electromagnetic control device for a flush tank which includes a resilient or spring biasing device coupled between the armature and the link to the flush valve for effectively and economically operating the flush tank.

In accordance with one aspect of the invention, there is provided a control device for controlling a flush valve of a flush tank, the control device comprising a housing, a lever including a middle portion pivotally coupled to the housing and including a first end coupled to the flush valve of the flush tank and including a second end extended inward of the housing, a casing secured in the housing, an armature slidably received in the casing and including a first end, a spring member coupling the first end of the armature to the second end of the lever, and electromagnetic means for actuating the armature inward of the casing to rotate the lever about the middle portion of the lever via the spring member. The second end of the lever is moved downward by the flush tank when water flows out of the flush tank.

The electromagnetic means generates an electromagnetic field when the electromagnetic means is energized, the control device further includes means for maintaining the electromagnetic field generated by the electromagnetic means, such that the electromagnetic means is only required to be actuated or energized for a short period of time, such as 0.5 second. The casing includes a pipe provided therein for slidably receiving the armature, the electromagnetic field maintaining means includes a plurality of plates engaged on the pipe for maintaining the electromagnetic field generated by the electromagnetic means.

One or more magnets are disposed on the plates for maintaining the electromagnetic field generated by the electromagnetic means. The electromagnetic means includes a coil disposed on the armature for actuating the armature inward of the casing, and includes another coil disposed on the armature for actuating the armature outward of the casing. The armature may also be pulled outward of the casing via the spring member when the lever is rotated downward by the flush valve after the water flows out of the flush tank.

A seat is secured to the casing and has a recess for receiving a second end of the armature. A securing device is further provided for securing the housing to the flush tank.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 3:
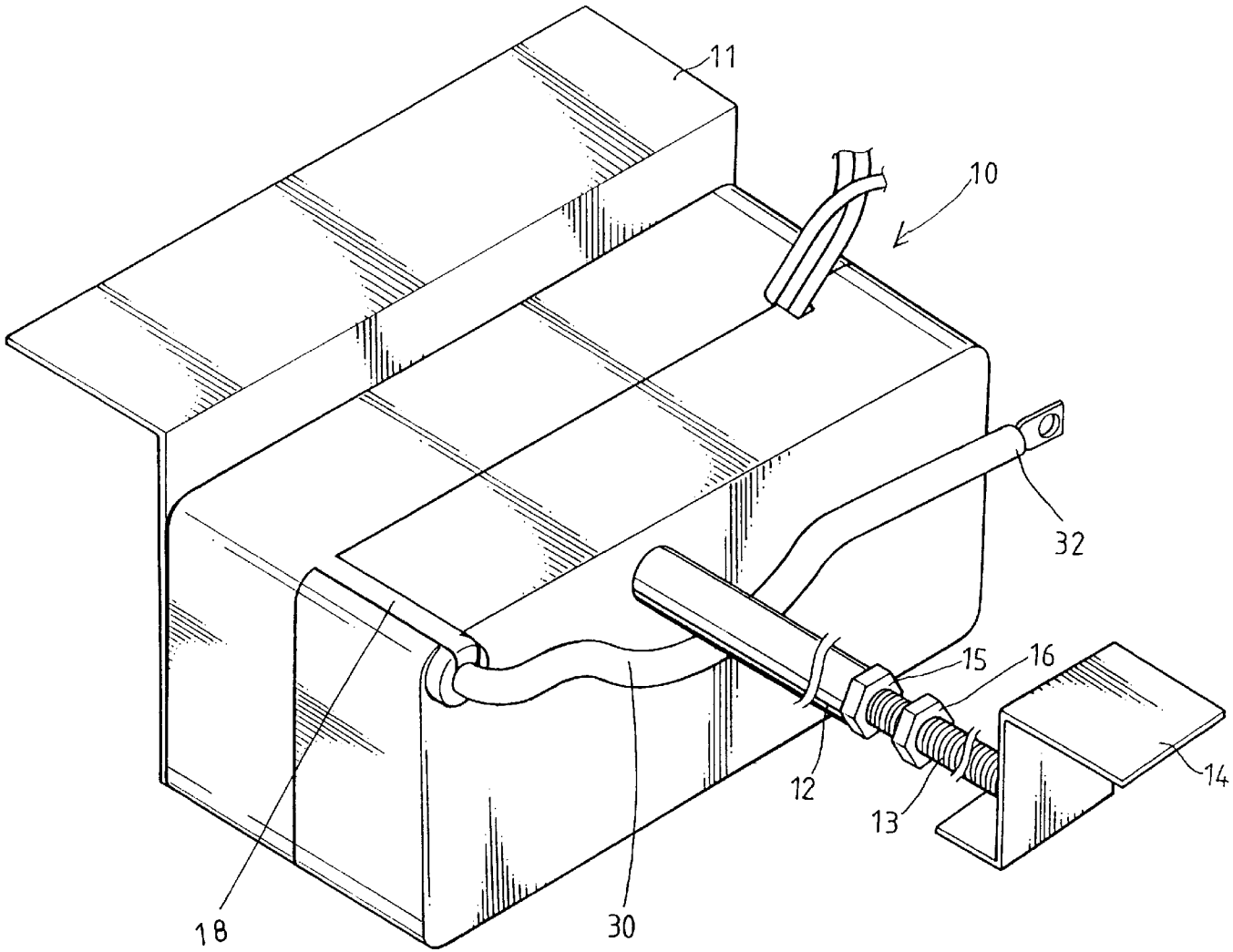
FIG. 3 is a perspective view of a control device in accordance with the present invention.
Figure 4:
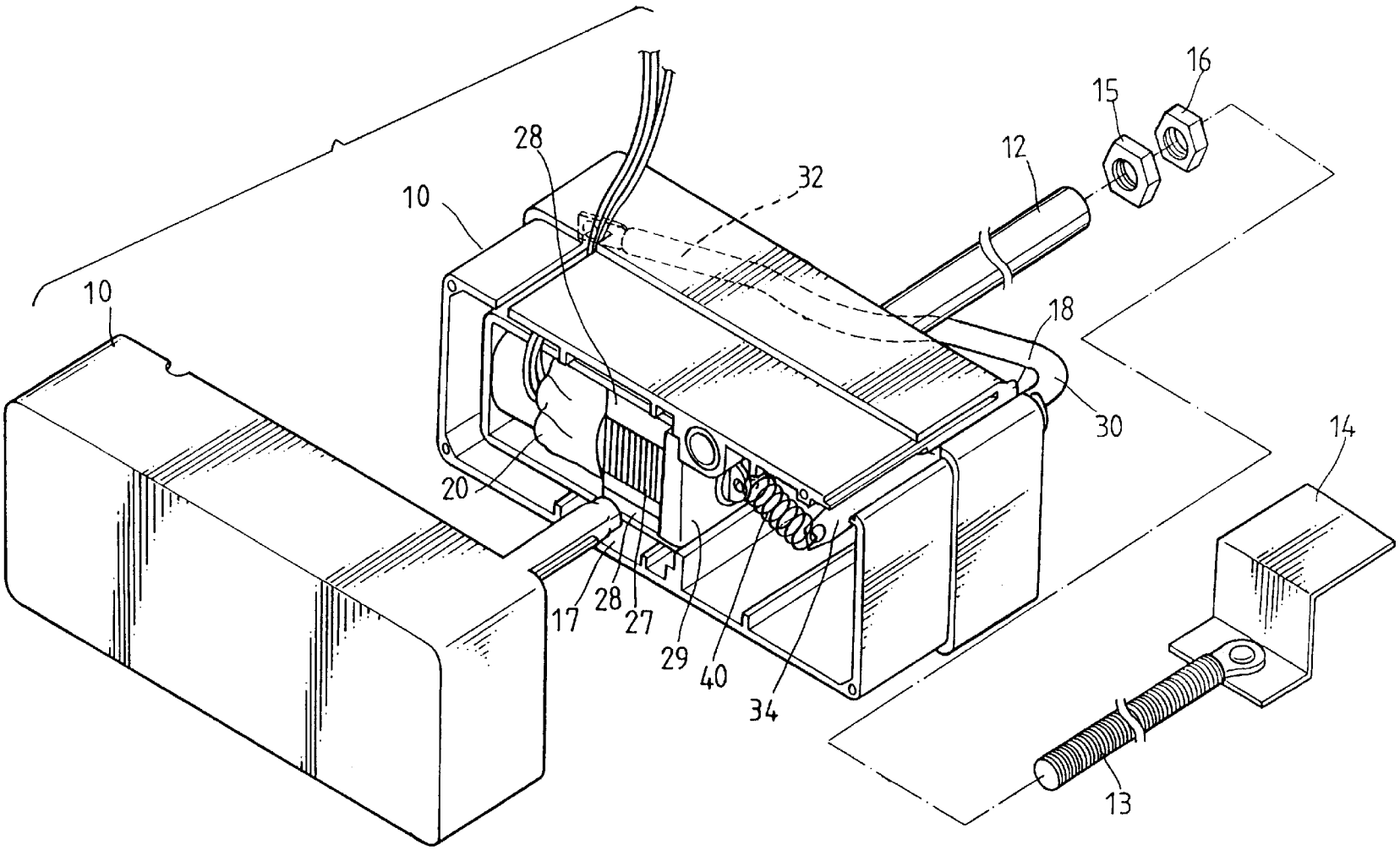
FIGS. 4 and 5 are partial exploded views of the control device.
Figure 5:
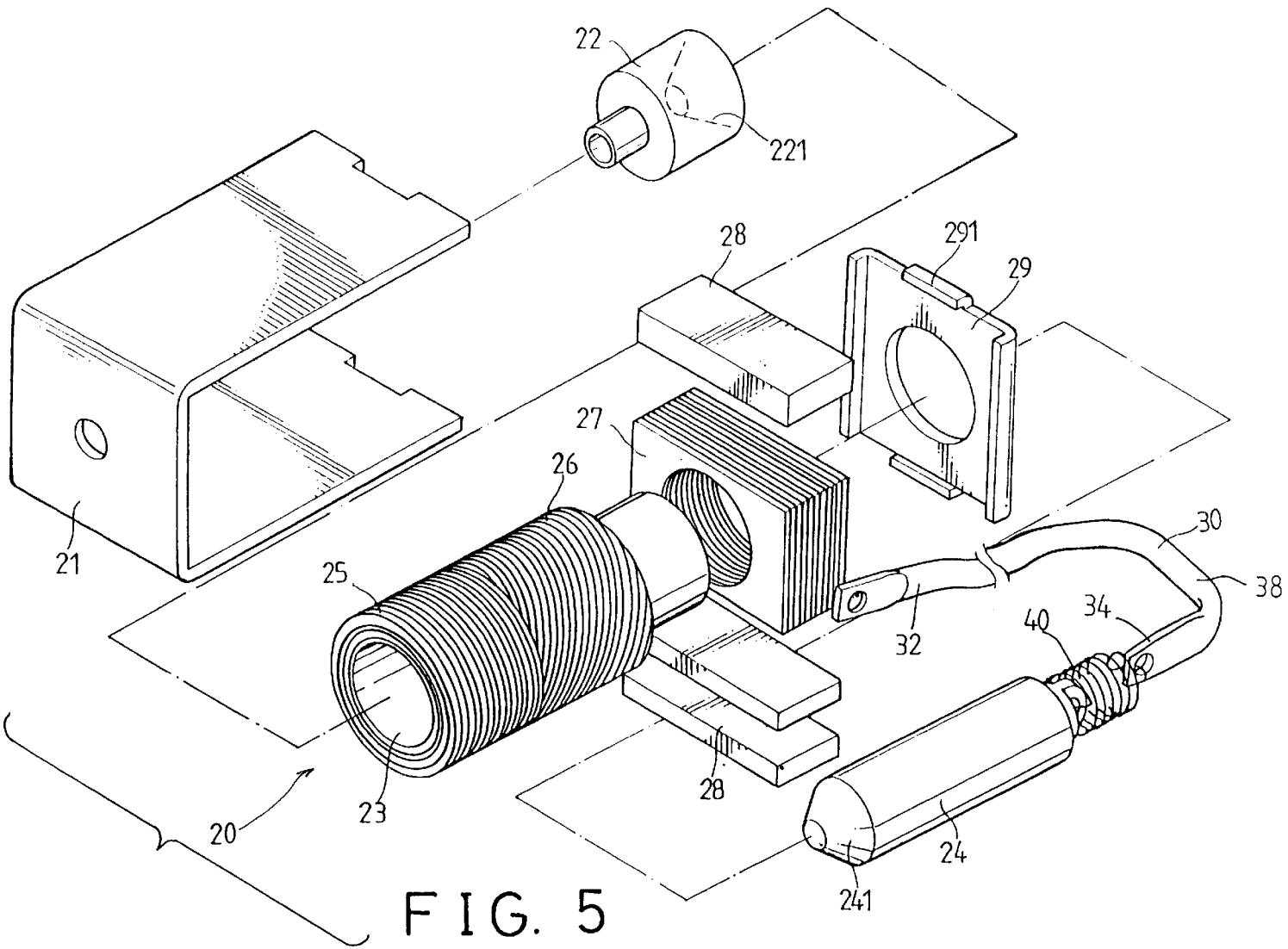

Referring to the drawings, and initially to FIGS. 1–4, a control device in accordance with the present invention comprises a housing 10 including a bracket 11 secured to one side thereof for engaging onto the flush tank 80 (FIG. 2) and including a tube 12 extended from the other side thereof. A bolt 13 has a bracket 14 secured to one end thereof for engaging onto the flush tank 80 (FIG. 2) and has the other end engaged in or secured or threaded into the tube 12. Two nuts 15, 16 are engaged on the bolt 13 for engaging with the tube 12 and for locking the housing 10 of the control device to the flush tank 80. The flush tank 80 includes a typical flush valve 82 and a link 88 coupling the flush valve 82 to an actuating lever 30 of the control device 10. The control device includes a sensing device, such as an infrared ray sensing device 51 disposed in a box 50 and disposed above the flush tank 80 (FIG. 1) for detecting the user and for controlling the control device. The housing 10 includes a chamber 17 formed therein (FIG. 4) for receiving a casing 21 of an electromagnetic device 20, and includes a channel 18 formed therein for rotatably receiving a middle portion 38 of the lever 30 (FIGS. 3–5). The lever 30 includes one end 32 coupled to the link 88 and the other end 34 extended inward of the housing 10.

Figure 6:
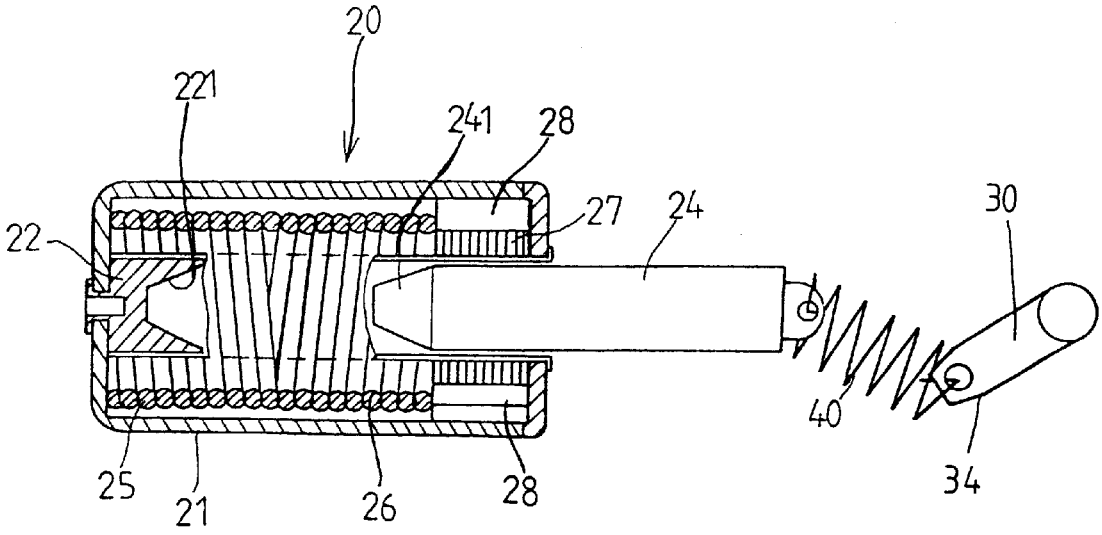

Referring next to FIGS. 5, 6 and again to FIG. 4, the electromagnetic device 20 includes a seat 22 secured to one end of the casing 21 and having a recess 221 formed therein. The casing 21 includes a cap 29 secured to the other end and having one or more projections 291 extended therefrom (FIG. 5) for engaging into the casing 21. The cap 29 is preferably solidly secured to the casing 21 by such as a welding process. A pipe 23 is disposed in the casing 21 and has one end secured to the cap 29 and has the other end aligned with or engaged onto the seat 22. A movable or slidable armature 24 is slidably engaged in the pipe 23 and has one end 241 to be engaged into the recess 221 of the seat 22 and has the other end coupled to the other end 34 of the lever 30 via a spring 40. Two coils 25, 26 are engaged on the pipe 23 for generating the electromagnetic forces of different directions and for moving the armature 24 to different directions along the pipe 23. A number of silicon-steel plates 27 are engaged on one end of the pipe 23 and one or more permanent magnets 28 are disposed on top and below the plates 27.

The casing 21, the armature 24, the seat 22, the plates 27 and the cap 29 are made of magnetic permeable materials for forming the magnetic induction (FIG. 8) for the electromagnetic device 20. The pipe 23 are made of the materials that have no magnetic permeability.

Figure 1:
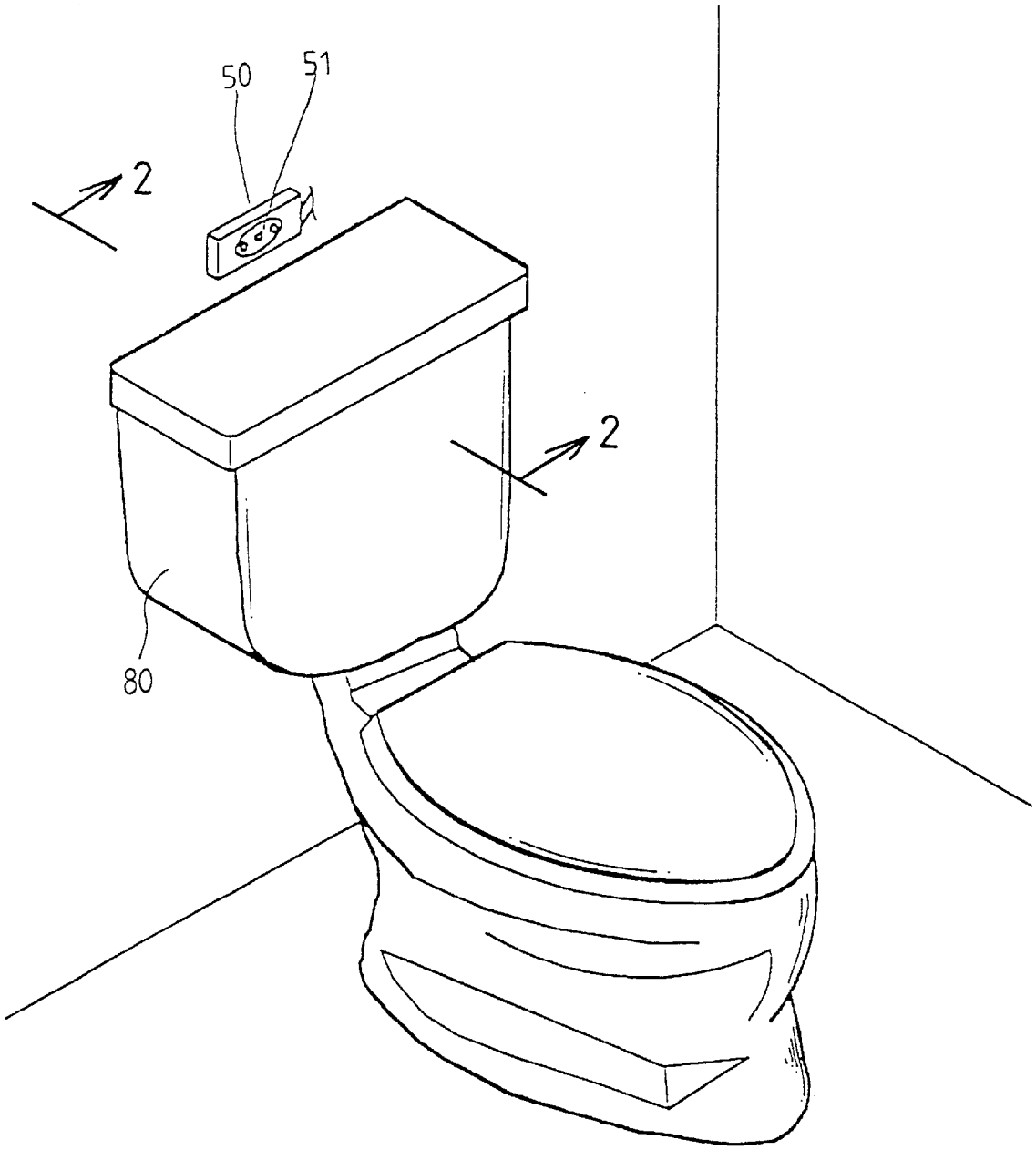
FIG. 1 is a perspective view of a toilet.
Figure 8:
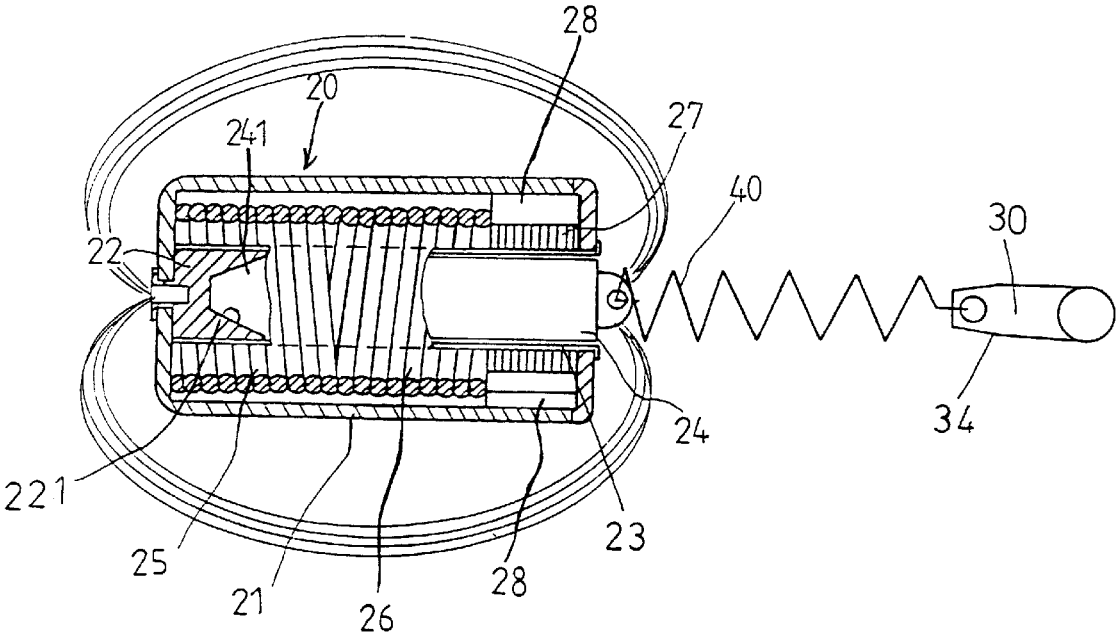
FIGS. 6, 7, 8 are partial cross sectional views illustrating the operation of the control device.
Figure 2:
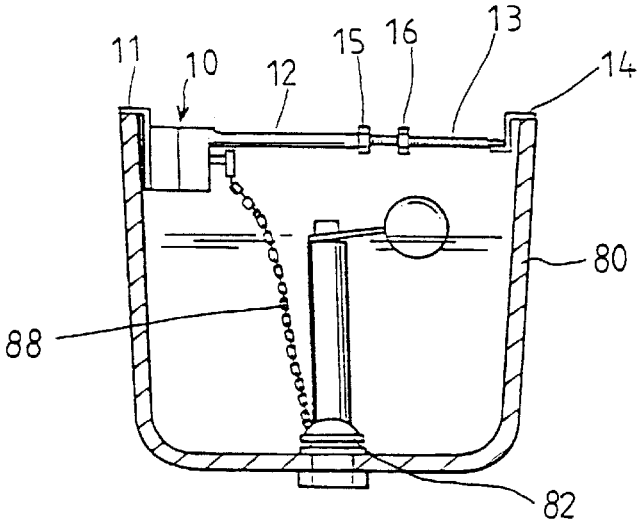
FIG. 2 is a cross sectional view taken along lines 2—2 of FIG. 1.
Figure 7:
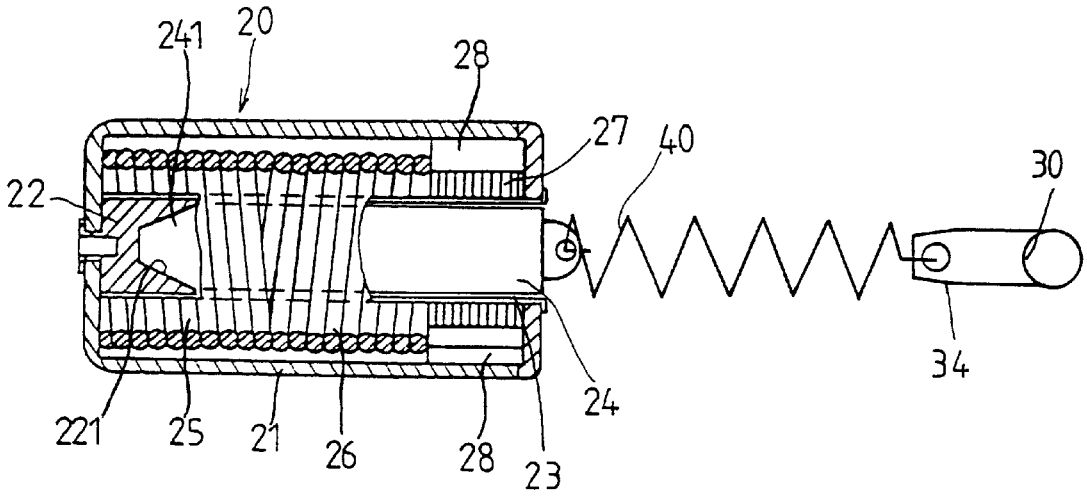

When the coil 25 is energized, the armature 24 may be moved inward of the pipe 23, for example, by the magnetic field generated by the coil 25 (FIGS. 7 and 8). The plates 27 and the permanent magnets 28 may maintain the magnetic field such that the coil 25 is only required to be energized for about 0.5 second. The energy required for actuating the coil 25 is thus greatly decreased. When the coil 25 is not energized or when the other coil 26 is energized for about 0.5 second, the armature 24 may be forced outward of the casing 21 (FIG. 6) to release the lever 30, and the plates 27 and the permanent magnets 28 may maintain the magnetic field such that the coil 26 may also be energized with the least energy. Alternatively, without the coil 26, the armature 24 may also be moved outward of the casing 21 by a spring-biasing member when the coil 25 is de-energized.

In operation, the end 32 of the lever 30 which is coupled to the flush valve 82 via the link 88 (FIGS. 2–5) may be pulled downward by the flush valve 82 (FIG. 2) when water flows out of the water tank 80. At this moment, the lever 30 may rotate about the middle portion 38 thereof such that the other end 34 of the lever 30 may also be moved or rotated downward to the lower position (FIGS. 4, 6) by the flush valve 82. When the coil 25 is energized, the armature 24 may be moved inward of the pipe 23, by the magnetic field generated by the coil 25 (FIGS. 7 and 8), to pull the other end 34 of the lever 30 upward (FIGS. 7, 8), such that the lever 30 may be rotated about the middle section 38 thereof by the armature 24 via the spring 40. The plates 27 and the permanent magnets 28 may maintain the magnetic field for a period of time which is good enough for allowing the water to flow out of the flush tank 80, such that the coil 25 is only required to be energized for about 0.5 second and such that the energy required for actuating the coil 25 is thus greatly decreased.

After the flushing operation, the end 32 of the lever 30 may be pulled downward again by the flush valve 82 via the link 88. When the coil 25 is de-energized, or when the coil 26 is energized for about 0.5 second, the armature 24 may be forced outward of the casing 21 (FIG. 6) to further release the lever 30. Or, relatively, the armature 24 may be pulled outward of the casing 21 by the other end 34 of the lever 30 via the spring 40, and ready for conducting the further flushing operation. It is to be noted that the armature 24 is not directly coupled to the lever 30, but coupled indirectly to the lever 30 via the spring 40, such that the force applied onto the armature 24 is not required to be as large as that is required to rotate the lever 30.

Accordingly, the flush tank in accordance with the present invention includes an electromagnetic control device that may be effectively and economically operated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A control device for controlling a flush valve of a flush tank, said control device comprising:

a housing, a lever including a middle portion rotatably received in said housing and including a first end coupled to the flush valve of the flush tank and including a second end extended inwardly of said housing, a casing secured in said housing, an armature slidably received in said casing and including a first end, a spring member coupling said first end of said armature to said second end of said lever, electromagnetic means for actuating said armature located inwardly of said casing, actuation of said electromagnetic means will rotate said lever about said middle portion of said lever via urging by said spring member causing said second end of said lever to be moved to lift said flush valve allowing water to flow out of the flush tank.

2. The control device according to claim 1, wherein said electromagnetic means generates an electromagnetic field when said electromagnetic means is energized, said control device further includes means for maintaining said electromagnetic field generated by said electromagnetic means.

3. The control device according to claim 2, wherein said casing includes a pipe provided therein for slidably receiving said armature, said electromagnetic field maintaining means includes a plurality of plates engaged on said pipe for maintaining said electromagnetic field generated by said electromagnetic means.

4. The control device according to claim 3 further comprising at least one magnet disposed on said plates for maintaining said electromagnetic field generated by said electromagnetic means.

5. The control device according to claim 1, wherein said electromagnetic means includes a coil disposed on said armature for actuating said armature inward of said casing.

6. The control device according to claim 1, wherein said electromagnetic means includes a coil disposed on said armature for actuating said armature outward of said casing.

7. The control device according to claim 1 further comprising a seat secured to said casing and having a recess formed therein for receiving a second end of said armature.

8. The control device according to claim 1 further comprising means for securing said housing to the flush tank.

* * * * *